United States Patent [19]

Bortoluzzi

[11] 4,079,244

[45] Mar. 14, 1978

[54] LIGHT FIXTURE

[76] Inventor: Pietro Bortoluzzi, 133 Via Roma, Godega di S. Urbano, Italy, 31010

[21] Appl. No.: 655,603

[22] Filed: Feb. 5, 1976

[30] Foreign Application Priority Data

Feb. 11, 1975 Italy ..... 12455 A/75
Oct. 16, 1975 Italy ..... 12835 A/75

[51] Int. Cl.[2] ..... F21V 21/08; H01R 13/60

[52] U.S. Cl. ..... 362/405; 339/121; 362/432

[58] Field of Search ..... 240/78 F, 78 QD, 73 QD, 240/73 BA, 78 DA, 73 DA, 52.1, 10 R, 10 T, 10 Q, 10 B, 10 S; 339/74 L, 75 P, 91 R, 91 L, 121, 158

[56] References Cited

U.S. PATENT DOCUMENTS

| | | | |
|---|---|---|---|
| 3,243,587 | 3/1966 | Relich | 240/52.1 X |
| 3,356,840 | 12/1967 | Cohen | 240/78 |
| 3,465,282 | 9/1969 | Berges et al. | 339/121 |
| 3,840,842 | 10/1974 | Gabryelewicz | 240/10 R X |

FOREIGN PATENT DOCUMENTS

| | | | |
|---|---|---|---|
| 890,541 | 9/1953 | Germany | 240/78 F |
| 586,601 | 10/1933 | Germany | 240/73 BA |

*Primary Examiner*—Richard A. Wintercorn
*Attorney, Agent, or Firm*—Pollock, Vande Sande & Priddy

[57] ABSTRACT

A light fixture comprises a central support body of circular shape presenting on its periphery a plurality of angularly equispaced sockets. Projecting at the interior of each socket cavity there are arranged vertically superposed electrical contacts in the form of male or pin contacts, which are connected to an electric circuit leading to the network. Inside each socket there can be inserted or "nested" a plug made of electrically insulating material, which carries a series of electrical contacts in the form of female or jack contacts, in a number corresponding to the number of pin contacts of the socket, and arranged in such a manner that, upon insertion or nesting of the plug into the socket, the pin contacts engage the corresponding jack contacts, thus establishing an electrical connection between the network circuit and the lamp circuit of the lamp-carrying arm attached to the said plug. The plug and the socket present such a shape or section as to avoid rotation of the plug around its nesting axis, once inserted in the socket.

9 Claims, 17 Drawing Figures

LIGHT FIXTURE

SUMMARY OF THE INVENTION

The present invention relates to a sectional light fixture, of the type comprising a central support body usually of circular or polygonal shape, provided on its periphery with a plurality of socket cavities inside which there can be inserted or "nested" as many plugs forming part of a lamp-carrying arm.

The main characteristic feature of the present invention resides in the fact that each socket cavity of the support body presents a series of electrical contacts connectable in an easy and simple manner to the electric current network. Correspondingly, each plug of each lamp-carrying arm is provided with a series of electrical contacts which are connected to the electric lamp circuit. In this manner, the assembly of the light fixture can be performed simply by nesting the lamp-carrying plugs inside the sockets of the central support body.

The light fixture according to the invention can therefore be assembled even by an inexperienced person, such as a purchaser who intends to install it personally. Moreover, the light fixture can be packaged, for purposes of storage or shipment, in a very limited space, because the central body and the disassembled lamp-carrying arms occupy far less space than the assembled light fixture. Still another advantageous feature of the light fixture according to the invention derives from the fact that if a sectional unit forming part of same, such as a lamp-carrying arm or even the central support body, should be broken or become damaged, it can easily be replaced, without the need of specialized personnel.

The above and other features of the invention will appear evident from the following detailed description of some preferred embodiments of same, made with reference to the attached drawings.

DESCRIPTION OF THE PREFERRED EMBODIMENT

Figure 1:
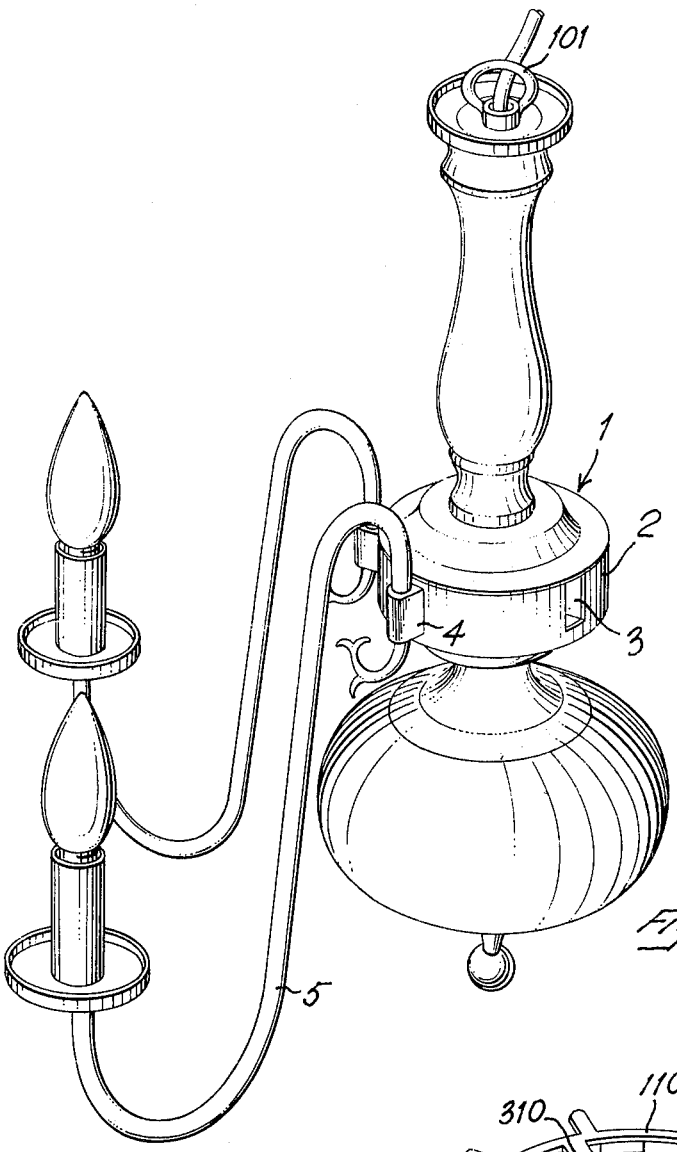
FIG. 1 is a perspective view of the light fixture according to the invention, with two lamp-carrying arms assembled onto the central support body.

Referring to FIG. 1, the sectional light fixture comprises a central support body which may have any one of a number of shapes, for aesthetical purposes, and which either is suspended from the ceiling, as shown in the illustrated embodiment (a suitable ring 101 being provided for the connection with a hook) or it can be mounted on an upright column to be placed on the floor. The central support body 1 presents a substantially cylindrical portion 2, provided with a plurality of angularly equispaced cavities or sockets 3, into each one of which there is nested, upon assembly of the light fixture, the plug element 4 of a lamp-carrying arm 5.

The socket-carrying portion 2 consists of an outer covering, usually of metal, comprising a lower casing 102 closed by an upper lid 202. Inside the said covering there is housed the proper socket-forming element, in the form of a supporting disc 6, made of electrically insulating material, which presents suitably spaced partition walls 7 which define the parallelepipedal socket cavities 3. The disc 6 further presents a central hub portion 8 provided with a plurality of angularly equispaced recesses 108 and with a central through bore 208. A lid disc 9, also provided with a central through bore 109 is provided to cover the top of the body consisting of disc 6, partitions 7 and central hub 8. The said lid disc 9 is also made of electrically insulating material. The described socket-forming element is assembled in an evident manner, by using any suitable tie rod (which in the present instance is tubular, so as to permit the passage of the electric leads) and tightening nuts.

In correspondence of the inner end or bottom of the sockets 3 defined by the partitions 7 of disc 6, there are arranged the pin contacts 10 for the electrical connection with the jacks provided on the plugs 4 of the lamp-carrying arm 5. According to the present embodiment, three pin contacts 10 are, vertically superposed in each socket, the lowermost and the uppermost serving for connection with the current leads, while the central one serves for the ground connection.

Figure 6A:
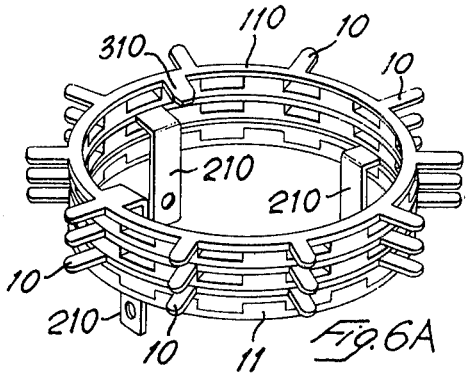
FIGS. 6 and 6A show respectively in exploded and assembled perspective view the package of conductor rings used in the construction of the socket-carrying portion of FIG. 2.
Figures 2, 3:
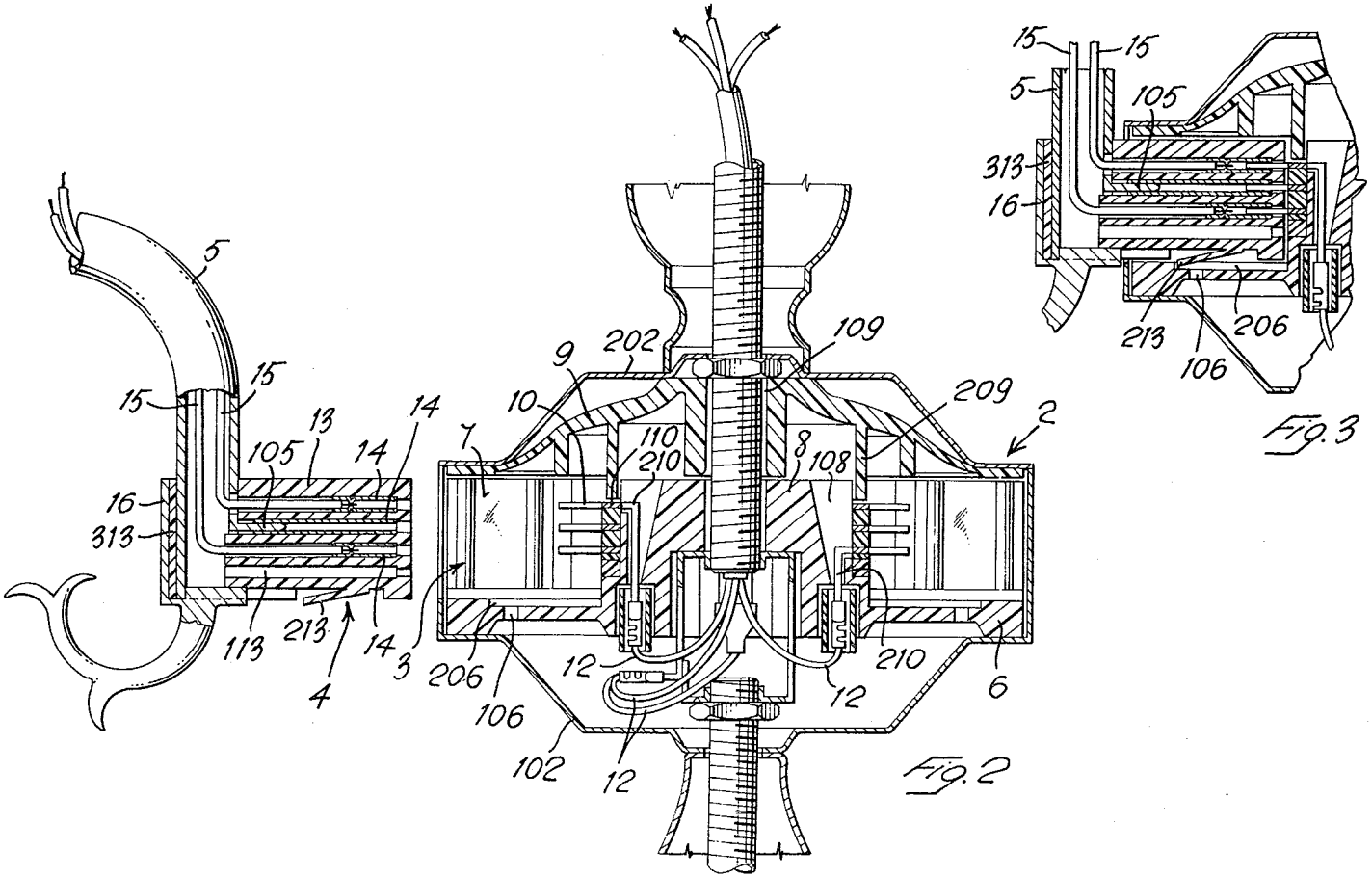
FIG. 2 is a section taken along a plane containing the central axis of the support body, showing the socket-carrying portion of said body, and a side section of the plug of the lamp-carrying arm, before insertion into the respective socket.
FIG. 3 is a fragmentary detail showing, according to the same section of FIG. 2, after insertion or "nesting" of the plug inside the socket.
Figure 6:
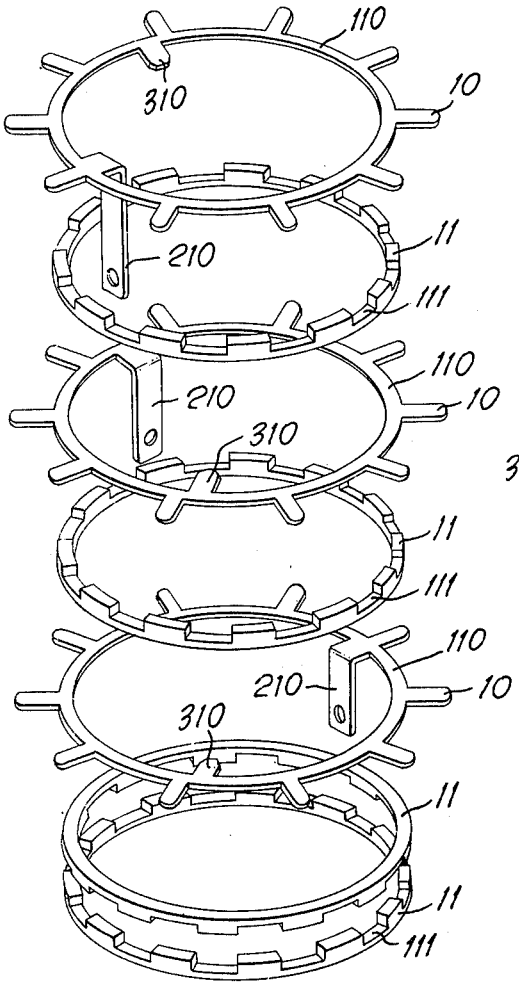
Figure 11:
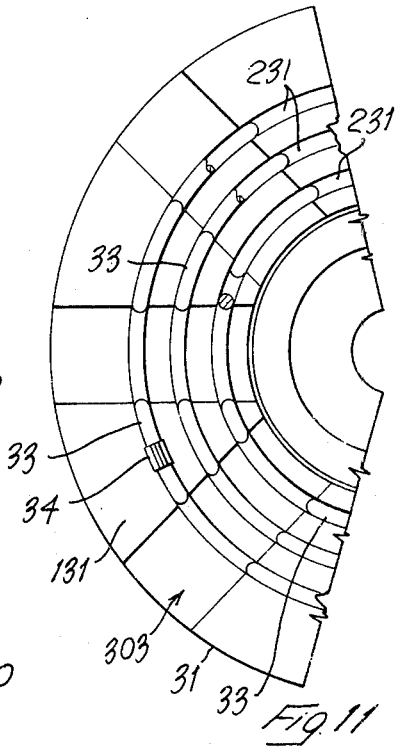
FIG. 11 is a top plan fragmentary view of the socket-carrying portion, according to a further modification the respective cover disc or element being omitted.
Figure 14:
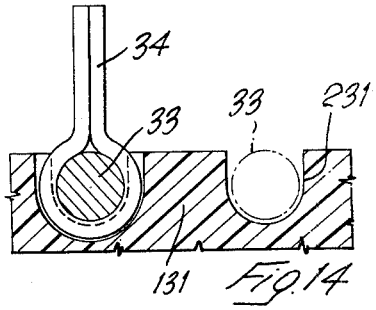
FIGS. 13 and 14 are details showing in section some particulars of the modification illustrated in FIGS. 11 and 12.
Figure 12:
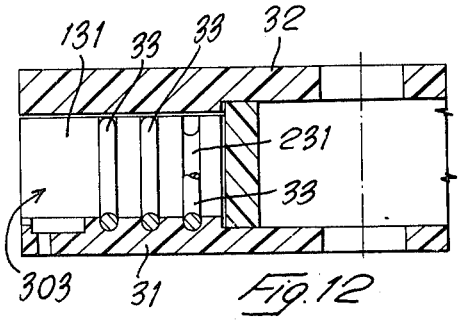
FIG. 12 is a side section of the socket-carrying portion according to FIG. 11, with the cover disc applied thereonto.
Figure 13:
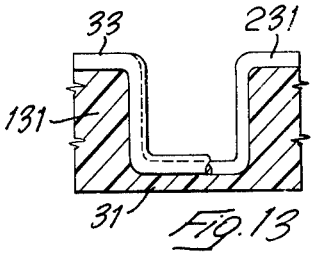

With particular reference to FIGS. 6 and 6A, it will be note that the pin contacts 10 comprise peripherally outwardly projecting appendices of conductor rings 110, which are superposed the one onto the other, with the interposition of electrically insulating rings 11 presenting on one side a merlon shaped surface, with corresponding recesses or crenels 111. Each conductor ring is provided with a downwardly directed inner tongue 210, which projects out of the thus formed package (see particularly FIG. 6A) and serves for the electrical connection to suitable terminals of the current and ground leads 12, as better shown in FIG. 2.

Also, each conductor ring 110 is provided with an inwardly directed dent 310 which, upon assembly of the formed package onto the hub portion 8 of disc 6, engages a corresponding recess 108 of said hub portion 8, thus ensuring stable positioning of such ring, without possibility of rotation.

Figure 4:
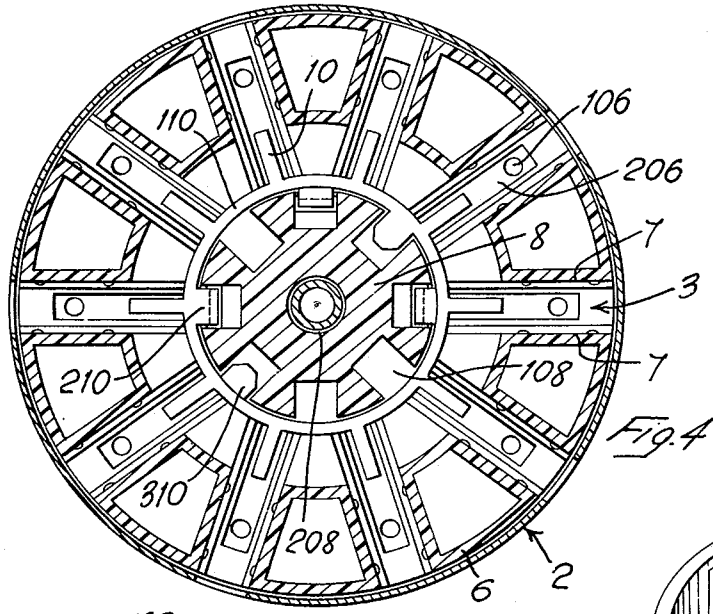
FIG. 4 is a sectional plan view of the socket carrying portion of FIG. 2.

As above mentioned, the package formed by the conductor rings 110 and insulating rings 11 is fitted into an annular space defined between the inner ends of the partition walls 7 and the peripheral surface of the hub portion 8, in such a manner that, in correspondence of each socket cavity defined by two partition walls 7, there project out the contact pins 10 of the superposed conductor rings 110, which are kept in place by the engagement of the inwardly directed dents 310 (and also tongues 210 - see FIG. 4) in the recesses 108 of the hub portion 8. The package is firmly kept in place by the downwardly directed flange 209 (see FIG. 2) provided on the lid disc 9.

Still with reference to FIGS. 6 and 6A, it will be noted that the first two bottom insulating rings 11 do not have a conductor ring 110 therebetween. This is due to the fact that, in the illustrated embodiment, just three contacts are required. If, for any particular purpose of commutation, or other requirement of the electric circuit, a fourth contact pin 10 should be required, another conductor ring can easily be sandwiched between the mentioned first two insulating rings 11.

If, as in the present case, no additional conductor ring is required, the insulating rings 11 are superposed with the merlons of one ring complementarily engaging the crenels 111 of the other. In this manner, the height of the package is increased only by an amount corresponding to the thickness of the conductor ring which is not required.

Each plug element 4 of the lamp-carrying arm 5 comprises a substantially parallelepipedal body 13, made of electrically insulating material, presenting a number of longitudinal cavities which corresponds at least to the number of contact pins 10 arranged in the corresponding socket 3. Each longitudinal cavity 113 houses a jack element 14 intended to cooperate with a corresponding contact pin 10, and connected either to the current leads 15 for the electric lamp, or to a dent 105 of the lamp-carrying arm 5, thus assuring the required ground connection. In the plug element shown in FIGS. 2 and 3 there appears, substantially parallel to the bottom of body 13, an empty longitudinal cavity 113 which is intended for an additional jack, in case that a corresponding additional contact pin should be provided in the socket 3.

Figure 5:
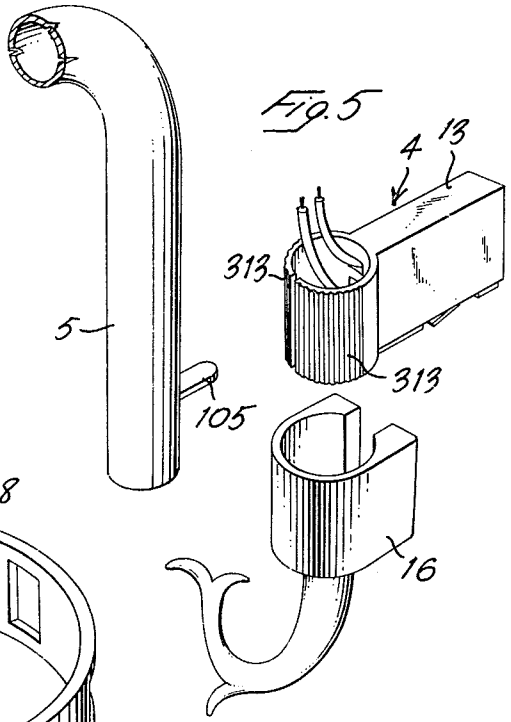
FIG. 5 is a perspective view showing the disassembled parts of the lamp-carrying arm and plug.

The lamp-carrying arm 5 is attached to the plug 4 by spreading (FIG. 5) a couple of resilient arcuate members or wings 313 provided at the outer end of body 13, and by inserting the corresponding lower portion of said arm 5 therebetween so as to plug dent 105 into the central jack 14 corresponding to ground. The resilient arcuate members or wings 313 then close again on arm 5, onto which they may also be glued, and onto the bottom of the thus assembled piece there is fitted a bottom cover 16 which is suitably shaped, so as to secure in place all the mentioned components. In order to assure a more stable assembly of the said components, the outer surface of the arcuate members 313 is grooved to provide greater friction with the inner surface of bottom cover 16, and these parts also may be glued together.

The thus prepared lamp-carrying arm 5 is nested, by its plug 4, into a corresponding socket 3 of the support body 1 (see FIG. 3), by inserting same axially into the socket and towards the center of the support body. In order to avoid an undesired sliding out of the plug 4 from the socket 3, a resilient tongue 213 is provided at the bottom end of body 13, and upon insertion into the mentioned socket 3, said tongue snaps outwardly so as to engage a corresponding recess 206 provided on disc 6 at the bottom side of each socket. A through bore 106 passing through the said bottom side in correspondence of said recess 206 (see particularly FIGS. 2, 3 and 4) is also provided, in such a manner as to permit the disengagement of the tongue 213, by pressing onto same with any suitable pointed tool, such as a screwdriver.

MODIFICATIONS

Figure 8:
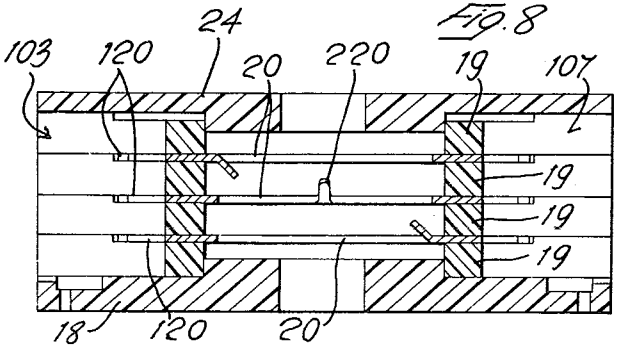
FIG. 8 is a side section, with the plug in view, of the modification according to FIG. 7.
Figure 7:
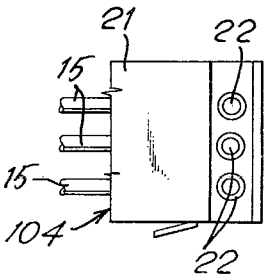
FIG. 7 is a view from the top, with parts in section, of a modification of the socket-carrying portion, with a respective plug not inserted.
Figure 7:
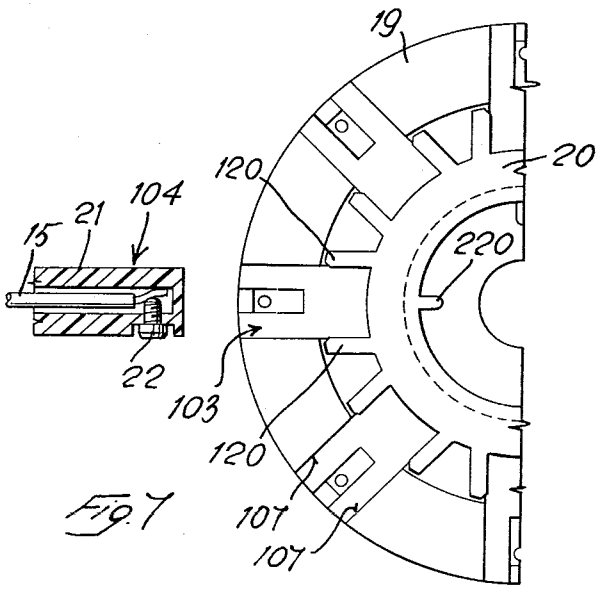

FIGS. 7 and 8 show a second embodiment of the invention, according to which the conductor rings 20 are arranged in a package with the interposition of insulating rings 19, which also define angularly equispaced composite partition walls 107, the whole being secured between the lower disc 18 and the upper disc 24. Each conductor ring is constructed in such a manner as to present, in correspondence of the inner end of each socket cavity 103 two contact surfaces 120 arranged each in correspondence of one vertical side wall of the socket 103. The contact surfaces are constructed as outwardly directed tongues 120 which slightly project out at the interior of each cavity. The connection to the electric circuit is obtained through the inner contacts 220 provided on each ring 20. The plug 104 which is adapted to be nested inside the corresponding cavity 103 is constructed as a parallelepipedal block 21, presenting three vertically arranged superposed contact heads 22 which are connected (they are actually constructed as screw clamps) to the electric leads leading to the circuit of the lamp-carrying arm.

Figure 10:
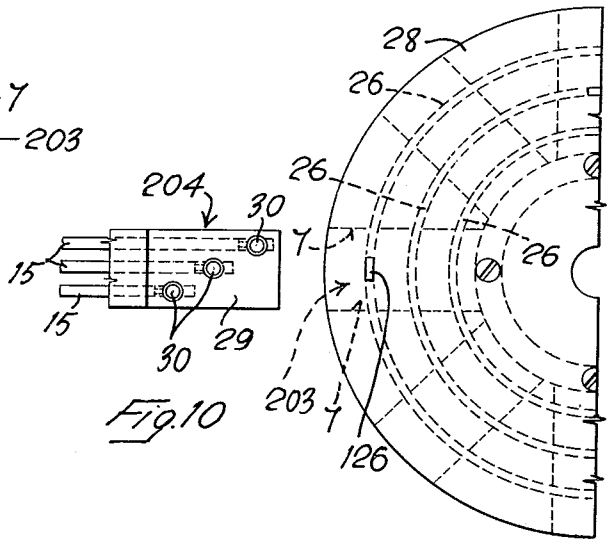
FIGS. 9 and 10 are views similar respectively to those of FIGS. 7 and 8, showing a further modification of the invention.
Figure 9:
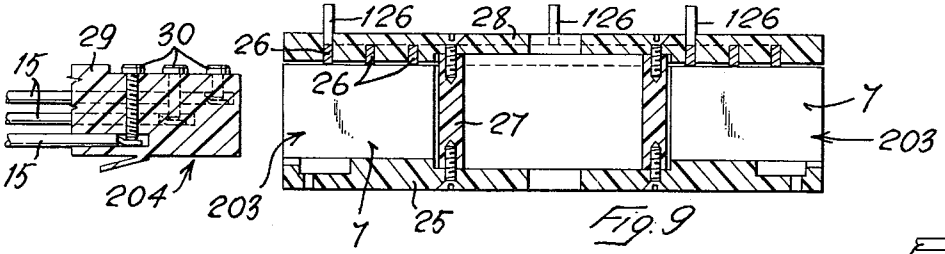

FIGS. 9 and 10 show a third embodiment according to which the conductor rings 26 of the socket-carrying element are arranged concentrically embedded in either one (or both) of the discs composing the said socket-carrying element (in the present case, they are embedded in the upper disc 28). The said conductor rings 26 project out of said disc 28 downwardly, thus defining a transversal contact surface slightly projecting at the interior of each socket 203, the connection to the current leads being assured by contacts 126 provided on the upper side of the said rings 26 and projecting out of the upper side of disc 28. The lower disc 25, which presents the partition walls 7, is secured to said upper disc 28 by any suitable means, such as screws, with the interposition of a cylindrical spacing member 27.

The plug member 204 of the lamp-carrying arm is constructed as a parallelepipedal body of insulating material, presenting suitable contacts 30 arranged on the horizontal upper side of said body 29 and spaced between each other so as to come into contact, whenever the plug is axially nested into the socket, with the corresponding conductor rings 26.

FIGS. 11 to 14 show a fourth embodiment according to which the lower disc 31 of the socket member presents circumferentially equispaced and suitably constructed vertical step-like portions 131, decreasing in section towards the center of the disc itself. An upper disc 32 is secured, in any suitable manner, onto the lower disc 31, thus defining sockets 303. The lower disc 31 presents a series of concentrically arranged continuous grooves 231 (see particularly FIG. 13), inside which there is laid a conductor wire 33. It will be appreciated that in this manner a contact surface is established along three sides of the inner surface of the socket, at the desired depth.

Any suitable plug member, such as for example the one illustrated in connection with FIGS. 9 and 10, will be apt to establish the contact between the socket conductor wires 33 and the conductor leads for the electric lamp circuit. The connection between the conductor wires 33 and the current circuit leading to the network is obtained by means of contacts 34 in the form of conductor straps inserted in suitably enlarged portions of the grooves 231 so as to clamp the wire 33 (see FIG. 14).

Figure 16:
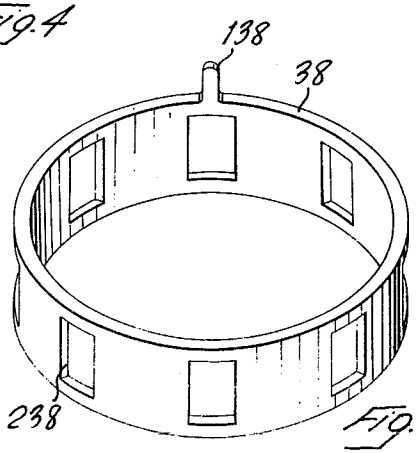
FIG. 16 is a perspective view of a conductor ring to be used in the modification according to FIG. 15.
Figure 15:
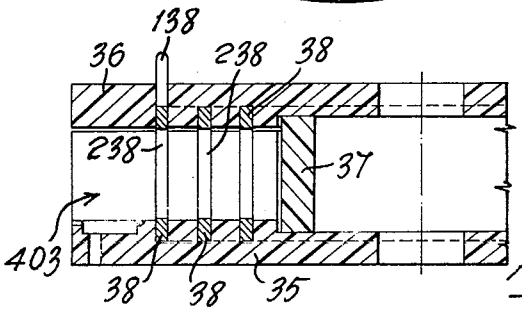
FIG. 15 is a fragmentary side section of still another modification of the socket-carrying portion.

Still another embodiment is shown in FIGS. 15 and 16. According to this embodiment, the contact surfaces in the sockets 403 are provided transversely on all four sides of the socket, by rectangular apertures 238 obtained in a series of concentrically arranged cylindrical rings 38 packed between a lower disc 35 and an upper disc 36, with the interposition of a spacing ring 37. The connection with the network current leads is obtained through suitable tongue contacts 138 projecting out of the upper disc 36. Also in the described embodiment, the plug member illustrated in connection with FIGS. 9 and 10 can be advantageously employed.

It is to be noted that in practically all the illustrated embodiments it is possible, with slight modifications and adaptations, to insert the plug of the lamp-carrying arm rotated 180° (or in some cases 90°). This increases the possibility of constructing, by employing just two basic sectional elements, light fixtures presenting differently oriented lamp-carrying arms.

Changes in the details of construction, particularly as as regards the type of electrical contacts used, the means and modes for insulating the electrically conductive parts, and the section or shape of the sockets, may be made to without departing from the spirit of the invention.

I claim:

1. A sectional light fixture of the type comprising a first sectional unit consisting of a support body having a plurality of socket cavities arranged about a central axis, a plurality of first electrical contacts connectable to an electric circuit being arranged in the interior of each socket cavity, and further comprising a plurality of second sectional units each consisting of a lamp-carrying member having a plug element, each plug element being adapted to be nested inside a said socket cavity and having a plurality of second electrical contacts connectable to the lighting circuit of the electric lamp carried by the lamp-carrying member, wherein (a) the said first electrical contacts are provided on a plurality of conductor rings arranged one above the other coaxially with the central axis of the support body;

(b) insulating rings being interposed between said conductor rings; and (c) each conductor ring being electrically connectable to a separate lead of the electric circuit.

2. A light fixture according to claim 1, wherein said first electric contacts comprise pin-like elements projecting outwardly from the conductor rings in the interior of the socket cavity, each conductor ring having pin-like contacts corresponding in number to the socket cavities, said second electrical contacts comprising jack-like elements housed in said plug element, whereby the connection between said first and second electrical contacts takes place upon insertion of the pin contacts inside the jack contacts when the plug element is nested inside the socket cavity.

3. A light fixture according to claim 2, in which the plug of the lamp-carrying arm or member is constructed of a body of electrically insulating material, inside which there are housed the jack contacts to be connected to the pin contacts of the respective socket, at least one of said jack contacts presenting, at the end opposite to the end which is intended to engage the respective pin contact of the socket, an extremity capable of being engaged by a dent provided on the lamp-carrying arm or member, upon assembly of said arm onto said plug.

4. A light fixture according to claim 3, in which the plug is provided, on its end opposite to the end which is inserted into the socket, with at least one flexible or articulated member or wing capable of being divaricated so as to consent the assembly of the arm onto the plug, and of being closed on said arm after its assembly on the said plug.

5. A light fixture according to claim 3, in which the lamp-carrying arm is made of electrically conductive material, and the jack of the plug engaged by the dent of said arm is intended for connection with a contact pin connected to the earth of the electric circuit.

6. A sectional light fixture of the type comprising a first sectional unit consisting of a support body having a plurality of socket cavities arranged about a central axis, a plurality of first electrical contacts connectable to an electric circuit being arranged in the interior of each socket cavity, and further comprising a plurality of second sectional units each consisting of a lamp-carrying member having a plug element, each plug element being adapted to be nested inside a said socket cavity and having a plurality of second electrical contacts connectable to the lighting circuit of the electric lamp carried by the lamp-carrying member, wherein (a) the said first electrical contacts comprise outwardly projecting tongues on a plurality of conductor rings arranged one above the other;

(b) insulating rings being interposed between the conductor rings; and (c) the tongues being arranged so as to project slightly beyond the inner side wall of the socket, so as to determine a contact surface for the respective said second electrical contact constructed as a contact surface on the plug element.

7. A sectional light fixture of the type comprising a first sectional unit consisting of a support body having a plurality of socket cavities arranged about a central axis, a plurality of first electrical contacts connectable to an electric circuit being arranged in the interior of each socket cavity, and further comprising a plurality of second sectional units each consisting of a lamp-carrying member having a plug element, each plug element being adapted to be nested inside a said socket cavity and having a plurality of second electrical contacts connectable to the lighting circuit of the electric lamp carried by the lamp-carrying member, including (a) an insulating disc defining a portion of the side wall of each socket cavity;

(b) a plurality of concentrically arranged conductor rings embedded in said insulating disc;

(c) said conductor rings projecting slightly out of said insulator disc so as to determine a contact surface for the respective said second electrical contact constructed as a contact surface on the plug element.

8. A sectional light fixture of the type comprising a first sectional unit consisting of a support body having a plurality of socket cavities arranged about a central axis, a plurality of first electrical contacts connectable to an electric circuit being arranged in the interior of each socket cavity, and further comprising a plurality of second sectional units each consisting of a lamp-carrying member having a plug element, each plug element being adapted to be nested inside a said socket cavity and having a plurality of second electrical contacts connectable to the lighting circuit of the electric lamp carried by the lamp-carrying member, wherein (a) the said first electrical contacts are provided on a plurality of concentrically arranged conductor rings of substantially cylindrical shape, each conductor ring having an aperture corresponding to each socket cavity, each aperture having substantially the same shape as the corresponding section of the socket cavity, whereby a contact surface is established along the entire inner perimeter of the said section of the socket cavity.

9. A sectional light fixture of the type comprising a first sectional unit consisting of a support body having a plurality of socket cavities arranged about a central axis, a plurality of first electrical contacts connectable to an electric circuit being arranged in the interior of each socket cavity, and further comprising a plurality of second sectional units each consisting of a lamp-carrying member having a plug element, each plug element being adapted to be nested inside a said socket cavity and having a plurality of second electrical contacts connectable to the lighting circuit of the electric lamp carried by the lamp-carrying member, wherein (a) the said first electrical contacts comprise continuous conductor wires partially housed in grooves provided in the sockets transversely of the socket axis, whereby a contact surface is established along a substantial portion of the inner perimeter of the section of the socket cavity defined by the groove.

* * * * *